US011128066B2

(12) United States Patent
Wu et al.

(10) Patent No.: US 11,128,066 B2
(45) Date of Patent: Sep. 21, 2021

(54) CONDUCTIVE COMPONENT STRUCTURE OF CONDUCTIVE WIRE CONNECTION DEVICE

(71) Applicants: SWITCHLAB INC., New Taipei (TW); SWITCHLAB (SHANGHAI) CO., LTD., Shanghai (CN); GAOCHENG ELECTRONICS CO., LTD., Shenzhen (CN)

(72) Inventors: Chih-Yuan Wu, New Taipei (TW); Wei-Chi Chen, New Taipei (TW); Ming-Shan Tai, New Taipei (TW)

(73) Assignees: Switchlab Inc., New Taipei (TW); Switchlab (Shanghai) Co., Ltd., Shanghai (CN); Gaocheng Electronics Co., Ltd., Guangdong (CN)

( * ) Notice: Subject to any disclaimer, the term of this patent is extended or adjusted under 35 U.S.C. 154(b) by 258 days.

(21) Appl. No.: 16/351,967

(22) Filed: Mar. 13, 2019

(65) Prior Publication Data

US 2019/0288413 A1 Sep. 19, 2019

(30) Foreign Application Priority Data

Mar. 16, 2018 (TW) ..... 107109100

(51) Int. Cl.
*H01R 4/24* (2018.01)
*H01R 4/26* (2006.01)
(Continued)

(52) U.S. Cl.
CPC ..... *H01R 9/2416* (2013.01); *H01R 4/4818* (2013.01); *H01R 4/4827* (2013.01); *H01R 9/223* (2013.01)

(58) Field of Classification Search
CPC ... H01R 4/48; H01R 9/22; H01R 9/24; H01R 13/04; H01R 13/111; H01R 4/4836
(Continued)

(56) References Cited

U.S. PATENT DOCUMENTS 5,362,259 A * 11/1994 Bolliger ..... H01R 9/2691 439/532
8,550,838 B2 * 10/2013 Osagle ..... H01R 12/515 439/441

(Continued)

FOREIGN PATENT DOCUMENTS

DE 202016101684 * 3/2016 ..... H01R 4/48

*Primary Examiner* — Abdullah A Riyami
*Assistant Examiner* — Thang H Nguyen
(74) *Attorney, Agent, or Firm* — Rosenberg, Klein & Lee

(57) ABSTRACT

A conductive component structure of conductive wire connection device is more securely assembled with the conductive wire to enhance the electro-conduction performance. The conductive component includes a main body in the form of a plate body and a restriction body connected on the main body. The restriction body has a base section, a first arm and a second arm connected with the base section and free sections connected with the first and second arms, which together provide elastic holding action force for the restriction body. When the conductive wire is plugged into the case into contact with the conductive component, the rear end of the conductive wire is at least securely pressed between the first and second arms of the restriction body without deflecting or swinging due to external force.

33 Claims, 13 Drawing Sheets

(51) Int. Cl.

| | |
|---|---|
| ***H01R 11/20*** | (2006.01) |
| ***H01R 4/48*** | (2006.01) |
| ***H01R 9/24*** | (2006.01) |
| ***H01R 9/22*** | (2006.01) |

(58) Field of Classification Search
USPC ..... 439/440, 441, 438, 834, 835, 786, 787
See application file for complete search history.

(56) References Cited

U.S. PATENT DOCUMENTS

| | | | | |
|---|---|---|---|---|
| 8,771,004 | B2 * | 7/2014 | Fehling | H01R 4/4818 439/441 |
| 9,768,527 | B2 * | 9/2017 | Bishop | H01R 4/183 |
| 9,774,107 | B2 * | 9/2017 | Kamo | H01R 4/4845 |
| 10,027,041 | B2 * | 7/2018 | France | H01R 9/2416 |
| 10,333,232 | B2 * | 6/2019 | Wu | H01R 9/2416 |
| 10,439,305 | B2 * | 10/2019 | Stjepanovic | H01R 4/48 |
| 10,535,932 | B2 * | 1/2020 | France | H01R 4/4827 |
| 10,707,598 | B2 * | 7/2020 | Fu | H01R 12/57 |
| 2005/0042912 | A1 * | 2/2005 | Drewes | H01R 31/08 439/441 |
| 2014/0127932 | A1 * | 5/2014 | Hoppmann | H01R 4/4827 439/370 |
| 2016/0049737 | A1 * | 2/2016 | Aporius | H01R 4/4809 439/733.1 |

* cited by examiner

CONDUCTIVE COMPONENT STRUCTURE OF CONDUCTIVE WIRE CONNECTION DEVICE

BACKGROUND OF THE INVENTION

1. Field of the Invention

The present invention relates generally to a conductive component structure of conductive wire connection device, and more particularly to a conductive component having a restriction body for guiding the conductive wire and helping in securing the conductive wire.

2. Description of the Related Art

A conventional terminal device or switch wire connection device has an insulation case (generally made of plastic material), a metal component (or so-called electrical conductive component) and a leaf spring conductor (or so-called metal leaf spring). The metal component and the leaf spring conductor are enclosed in the insulation case to press and electrically connect with or release a conductive wire plugged in the terminal device.

Multiple conventional electrical connection terminals can be latched with a grounding rail (or conductive rail) in a row to set up a common grounding device of an electrical apparatus or mechanical equipment for conducting out the residual voltage or static of the machine. For example, US 2013/0143433 A1 "connection terminal", US 2014/0127932 A1 "electrical connection terminal" and U.S. Pat. No. 5,362,259 "ground conductor terminal" disclose typical examples.

Such electrical connection terminal or switch wire connection device generally includes an insulation case having a wire plug-in hole for the conductive wire to plug into the interior of the case. The case defines a chamber in which a conductive support (or conductive component) and a metal leaf spring are mounted. The metal leaf spring and the conductive component serve to press the conductive wire plugged into the case and contact or electrically connect with the conductive wire. Unless an operator uses a tool to extend into the case and push/press the metal leaf spring, the conductive wire cannot be released from the electrical connection or contact with the metal leaf spring and the conductive component.

The assembling structure of the conventional electrical connection terminal or switch wire connection device has some shortcomings in structure and operation application. For example, in practical wire layout operation, after a conductive wire is plugged into the case to connect with the conductive component, an operator will bend the conductive wire outside the case to perform wire trimming operation in accordance with the site space condition or wire layout path. The wire trimming operation is performed because when the metal leaf spring presses the conductive wire, a leverage effect is often produced to cause the rear end of the conductive wire to warp up (or leave the conductive component). As a result, the contact area between the conductive wire and the conductive support (or conductive component) is reduced to increase the impedance and raise the temperature of the conductive support. In case the temperature of the conductive support exceeds the heat tolerance of the plastic insulation case, the case will be damaged to affect the security.

In order to improve the shortcomings of insufficient pressing force and electro-conductive insecurity or efficiency, a conventional electrical connection terminal has been disclosed, which additionally includes a leaf spring arranged behind the metal leaf spring to help in pressing the conductive wire.

However, as well known by those who are skilled in this field, such electrical connection terminal is simply applicable to specific conductive wire or relatively small-diameter conductive wire to provide sufficient pressing force. When such conventional electrical connection terminal or switch wire connection device is connected with a large-diameter conductive wire, it often takes place that the pressing force applied by the metal leaf spring and the conductive component to the conductive wire is insufficient, the conductive wire can be hardly securely pressed, the rear end of the conductive wire is warped up and the conductive wire is apt to rotate, deflect or swing due to incautious touch of an operator to lead to poor contact and insecurity. This is not what we expect.

Another conventional electrical connection terminal has been disclosed, which includes a leaf spring and a steel leaf spring overlapped with the leaf spring to increase the pressing force for the conductive wire.

To speak representatively, the above reveals some shortcomings existing in the conventional wire connection terminal or switch wire connection device in structure assembly design and application. In case the structure assembly of the conductive component and the metal leaf spring or leaf spring conductor is redesigned to be different from the conventional wire connection terminal, the use form of the wire connection terminal can be changed to practically widen the application range thereof.

It is found that the structural form of an optimal conductive component must overcome or improve the aforesaid shortcomings of the conventional wire connection terminal and include several design considerations as follows:

1. In condition that the thickness of the conductive component and/or the metal leaf spring is not increased, the cooperative structures of the conductive component and/or the metal leaf spring must be able to provide sufficient pressing force so that the wire connection terminal or switch wire connection device is applicable to a large-diameter conductive wire. Also, the conductive component and/or the metal leaf spring of the electrical connection terminal must overcome the shortcomings of the conventional electrical connection terminal that the pressing force applied by the metal leaf spring and the conductive component to the conductive wire is insufficient, the conductive wire can be hardly securely pressed and the conductive wire is apt to deflect or swing due to incautious touch of an operator to lead to poor contact and insecurity.
2. As aforesaid, when the metal leaf spring presses the conductive wire, a leverage effect is often produced to cause the rear end of the conductive wire to warp up (or leave the conductive component). As a result, the contact area between the conductive wire and the conductive component is reduced to affect the electro-conduction efficiency. This shortcoming must be improved.
3. Moreover, the electrical connection terminal must provide a conductive component structure, which is able to help the metal leaf spring in pressing the conductive wire and is able to guide the conductive wire and help in fixing the conductive wire so as to minimize the possibility of rotation, deflection or swing of the conductive wire.

SUMMARY OF THE INVENTION

It is therefore a primary object of the present invention to provide a conductive component structure of conductive wire connection device, which is more securely assembled with the conductive wire to enhance the electro-conduction performance. The conductive component includes a main body in the form of a plate body and a restriction body connected on the main body. The restriction body has a base section, a first arm and a second arm connected with the base section and free sections connected with the first and second arms, whereby the restriction body can provide elastic holding effect. When the conductive wire is plugged into the case into contact with the conductive component, the rear end of the conductive wire is at least securely pressed between the first and second arms of the restriction body. The conductive component improves the shortcomings of the conventional structure that the conductive wire is apt to deflect or swing due to external force to lead to unstable contact and insecurity and affect the electro-conduction efficiency.

In the above conductive component structure of conductive wire connection device, the first arm and the second arm are respectively bent from two sides of the base section to obliquely extend toward each other to define a mouth section. In addition, a bent section is formed between each of the first and second arms and each of the free sections of the first and second arms. The free section of the first arm and the free section of the second arm are bent to extend away from each other to form an opening structure, whereby the restriction body can be elastically expanded to hold different diameters of conductive wires.

In the above conductive component structure of conductive wire connection device, the free section of the first arm and the free section of the second arm of the restriction body extend toward each other and connect with each other to form a connection section so as to together define a mouth section in a closed form. The first and second arms respectively have caved sections, which increase the elastic deformation amount of the first and second arms, whereby the first and second arms are uneasy to permanently deform and can more securely press and restrict the conductive wire.

The present invention can be best understood through the following description and accompanying drawings, wherein:

DETAILED DESCRIPTION OF THE PREFERRED EMBODIMENTS

Figure 1:
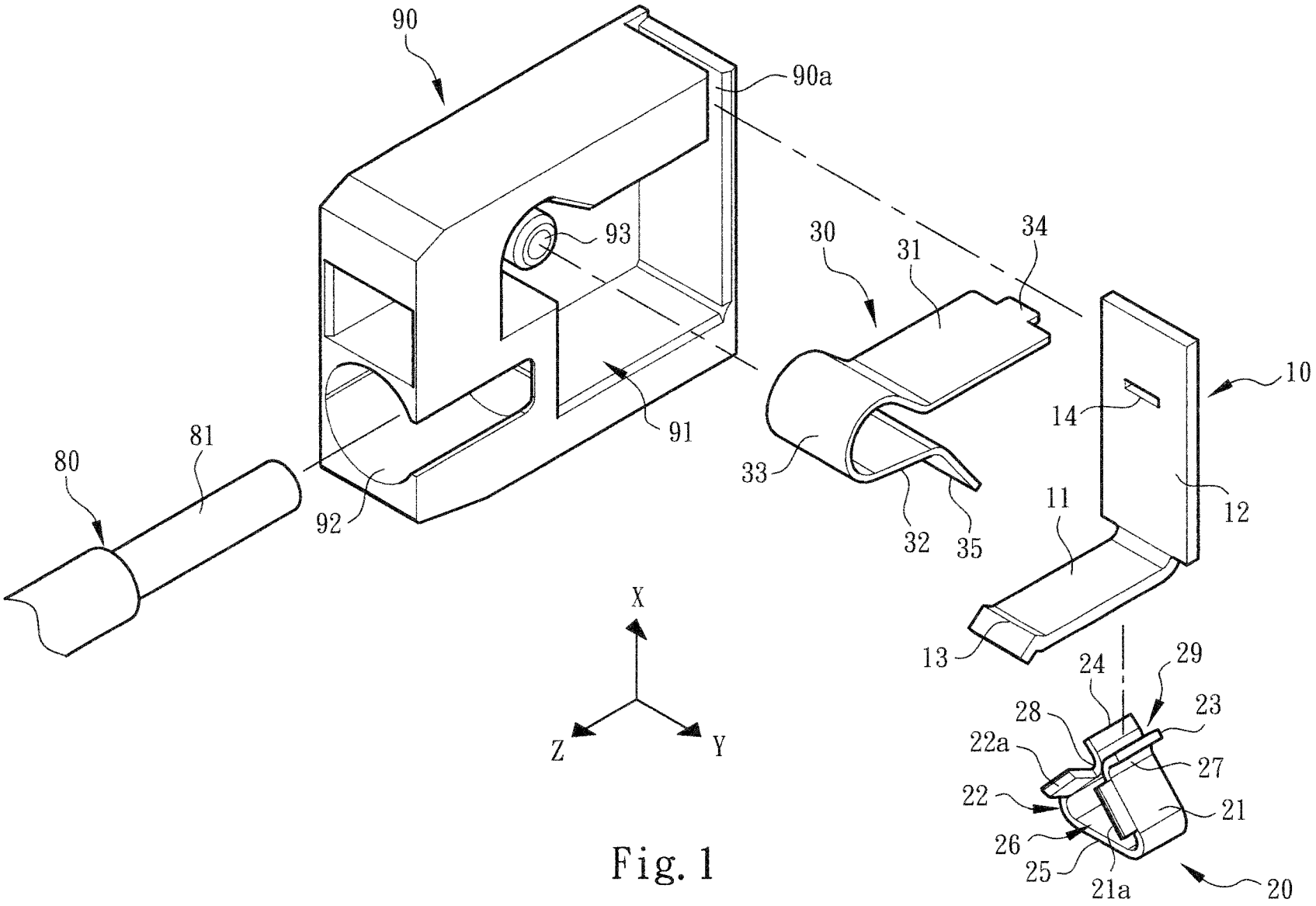
FIG. 1 is a perspective exploded view of the conductive component of the present invention, showing the structures of the case and the main body, the metal leaf spring and the restriction body of the conductive component.
Figure 2:
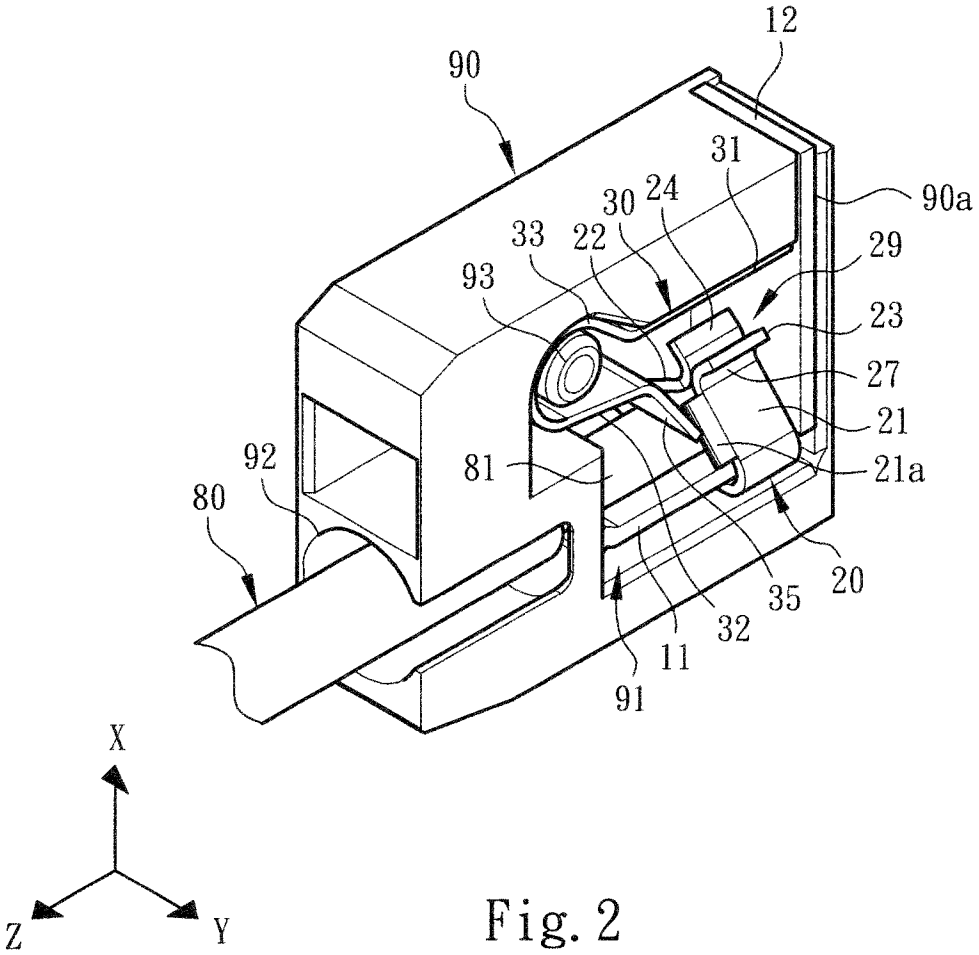
FIG. 2 is a perspective assembled view of the conductive component of the present invention.
Figure 3:
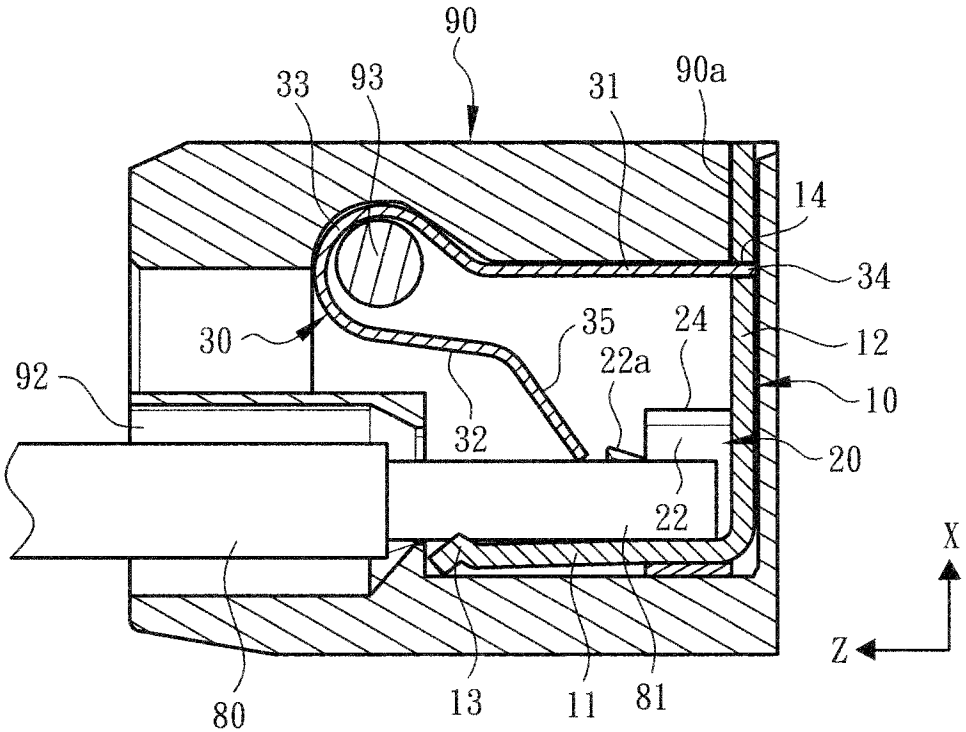
FIG. 3 is a plane view according to FIG. 2, showing the structural relationship between the main body, the metal leaf spring, the restriction body and the conductive wire.

Please refer to FIGS. 1, 2 and 3. The conductive component structure of conductive wire connection device of the present invention includes an assembly of a main body 10 and a restriction body 20. The conductive component (or the main body 10 and the restriction body 20) is defined with an X-direction reference axis, a Y-direction reference axis and a Z-direction reference axis normal to each other. The conductive wire 80 is plugged into the conductive component in a direction identical to or parallel to the Z-direction reference axis. Moreover, the conductive component in cooperation with a metal leaf spring 30 is mounted in a case 90 made of insulation material to form the wire connection terminal, the switch wire connection device or the like device.

Basically, the case 90 defines a chamber 91, in which the main body 10, the restriction body 20 and the metal leaf spring 30 of the conductive component are mounted. The case 90 has a wire plug-in hole 92 in communication with the chamber 91. The conductive wire 80 can be plugged through the wire plug-in hole 92 into the chamber 91 of the case 90 and the conductive component to electrically connect therewith.

The upper section, lower section, outer side and inner side mentioned hereinafter are recited with the direction of the drawings as the reference direction.

As shown in the drawings, the main body 10 is selectively made of an electro-conductive material (such as copper, brass or the like material) in the form of a plate body. The main body 10 has a first section 11 in parallel to the Z-direction reference axis and a second section 12 (perpendicularly) connected with the first section 11 (and extending along X-direction reference axis). The second section 12 is assembled and located in a locating slot 90*a* of the case 90. One end of the first section 11 is formed with a raised ridge section 13 as a load section for helping in pressing the conductive wire 80.

In a preferred embodiment, the restriction body 20 is integrally formed or assembled on the main body 10. The restriction body 20 is selectively made of an electro-conductive (metal) material and disposed on the first section 11 of the main body 10. The restriction body 20 has a base section 25, a first arm 21 and a second arm 22 connected with the base section 25 and free sections 23, 24 connected with the first and second arms 21, 22, which together provide elastic holding effect for the restriction body 20.

To speak more specifically, the first and second arms 21, 22 are respectively bent from two sides of the base section 25 to gradually obliquely extend toward each other along the X-direction reference axis (or in a direction normal to the plug-in direction of the conductive wire 80). The first and second arms 21, 22 define a mouth section 26 with a triangular configuration. A bent section 27, 28 is formed between each of the first and second arms 21, 22 and the free sections 23, 24, whereby the free section 23 of the first arm 21 and the free section 24 of the second arm 22 are bent to extend away from each other so as to define an opening 29, whereby the restriction body 20 can be elastically expanded to hold different diameters of conductive wires 80. As shown in the drawings, the opening 29 is open to the upper side (or along the X-direction reference axis).

FIGS. 1, 2 and 3 also show that wing sections 21*a*, 22*a* respectively protrude from the first and second arms 21, 22 of the restriction body 20 and diverge to outer side of the restriction body 20 in a direction to the conductive wire 80 plugged into the case 90 or the wire plug-in hole 92 (or along the Z-direction reference axis). The wing sections 21*a*, 22*a* serve to help in guiding the conductive wire 80 to enter the conductive component.

In this embodiment, the metal leaf spring 30 is a substantially V-shaped structure including a first section 31, a second section 32 and a bow section 33 connected between the first and second sections 31, 32. The first section 31 has a head end 34 secured in a locating hole 14 of the case 90 or the main body 10. The bow section 33 is assembled on a stake 93 of the case 90 or the chamber 91, whereby the tail end 35 of the second section 32 can be elastically biased to press the conductive wire 80. As shown in the drawings, the locating hole 14 is disposed on the second section 12 of the main body.

Figure 4:
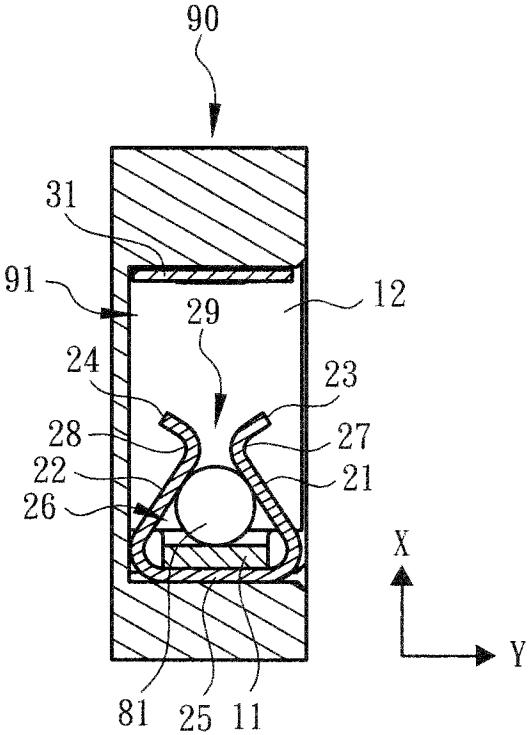
FIG. 4 is a sectional view of the present invention assembled with the conductive wire, showing that the main body and the restriction body are assembled with the conductive wire.

Please refer to FIGS. 3 and 4. When the conductive wire 80 is plugged into the wire plug-in hole 92 (along the Z-direction reference axis) to contact the conductive component, the tail end 35 of the second section 32 of the metal leaf spring (in cooperation with the ridge section 13 of the main body 10) presses the conductive wire 80 against the main body 10. The rear end 81 of the conductive wire 80 goes through the wing sections 21*a*, 22*a* into the mouth section 26 of the restriction body 20, whereby the conductive wire 80 is elastically securely held by the first and second arms 21, 22. This improves the shortcoming of the conventional electrical connection terminal that due to external force, the conductive wire is apt to deflect or swing to lead to unstable contact and affect the electro-conduction efficiency and security. Moreover, the first and second arms 21, 22 press the conductive wire 80 (or the rear end 81 of the conductive wire 80) toward the main body 10 or the center of the restriction body 20 (or the mouth section 26) to increase the electro-conductive contact area and the electro-conduction efficiency.

It should be noted that when a relatively large-diameter conductive wire is plugged into the conductive component and/or the wire trimming operation is performed, the rear end 81 of the conductive wire may be warped up. At this time, the rear end 81 of the conductive wire will be pressed/restricted or detained in the mouth section 26 by the first and second arms 21, 22 to keep in contact with the conductive component. This obviously improves the shortcoming of the conventional electrical connection terminal that the rear end of the conductive wire is apt to warp up and leave the conductive component so that the contact area between the conductive wire and the conductive component is reduced and the impedance is increased to raise the temperature of the conductive component.

Figure 5:
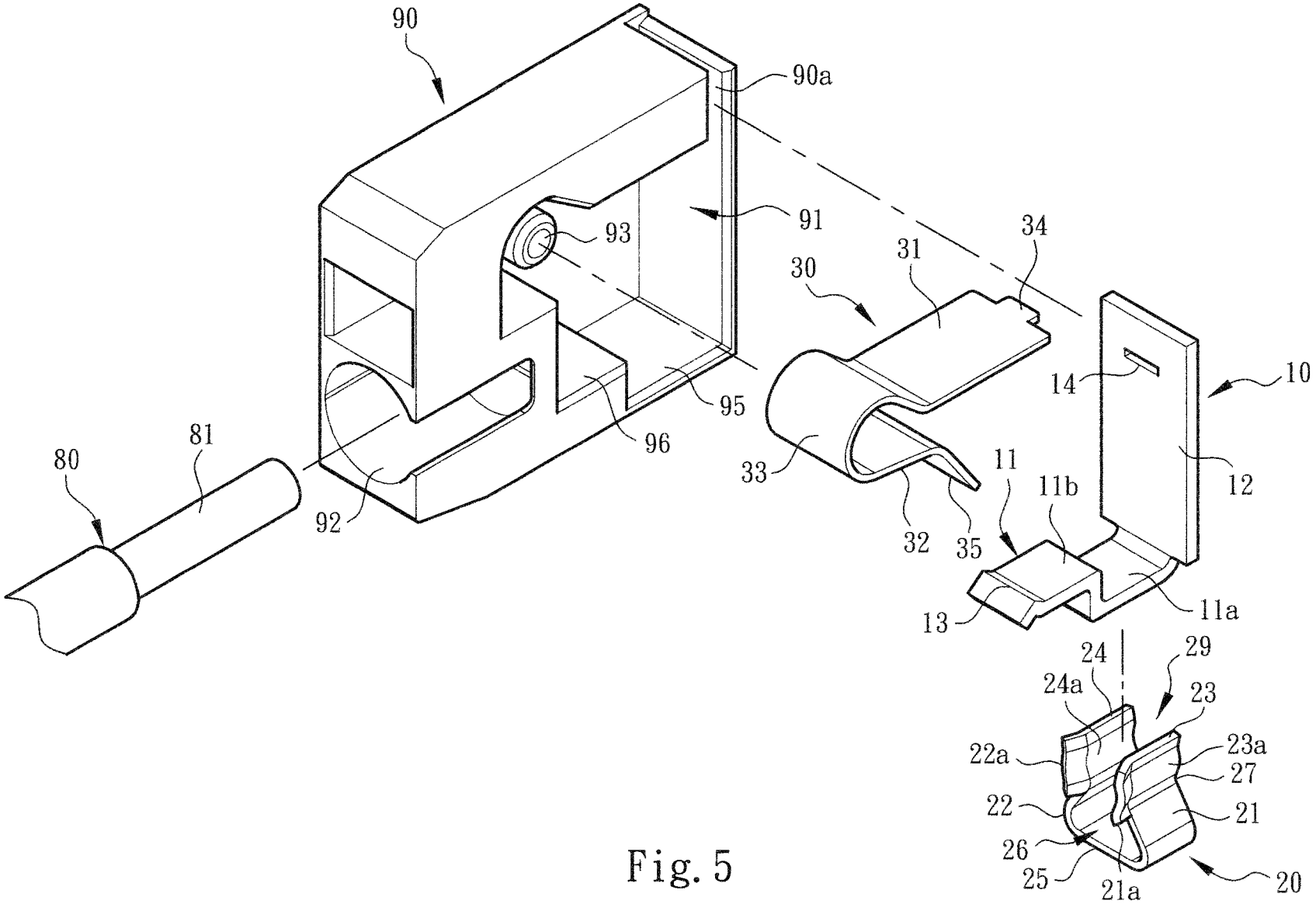
FIG. 5 is a perspective exploded view of a modified embodiment of the present invention, showing the structures of the case and the main body, the metal leaf spring and the restriction body of the conductive component.
Figure 7:
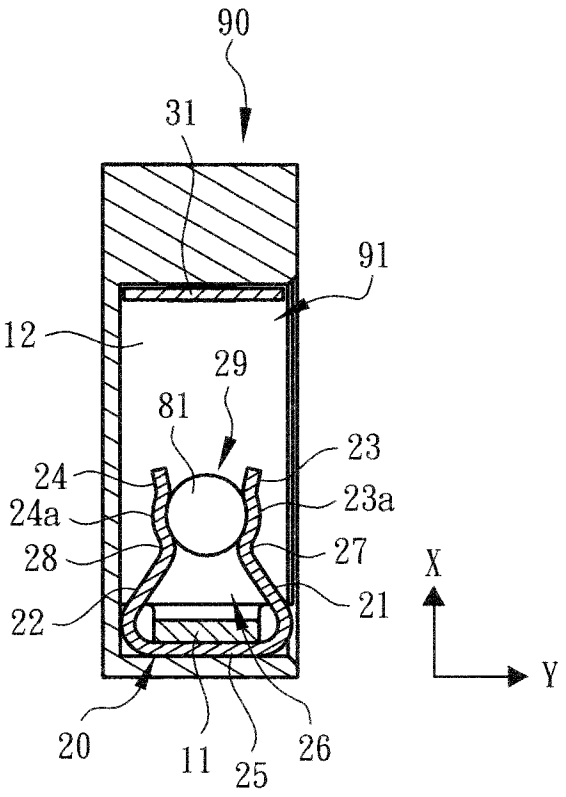
FIG. 7 is a sectional view according to FIG. 6, showing the structural relationship between the main body, the restriction body and the conductive wire.
Figure 6:
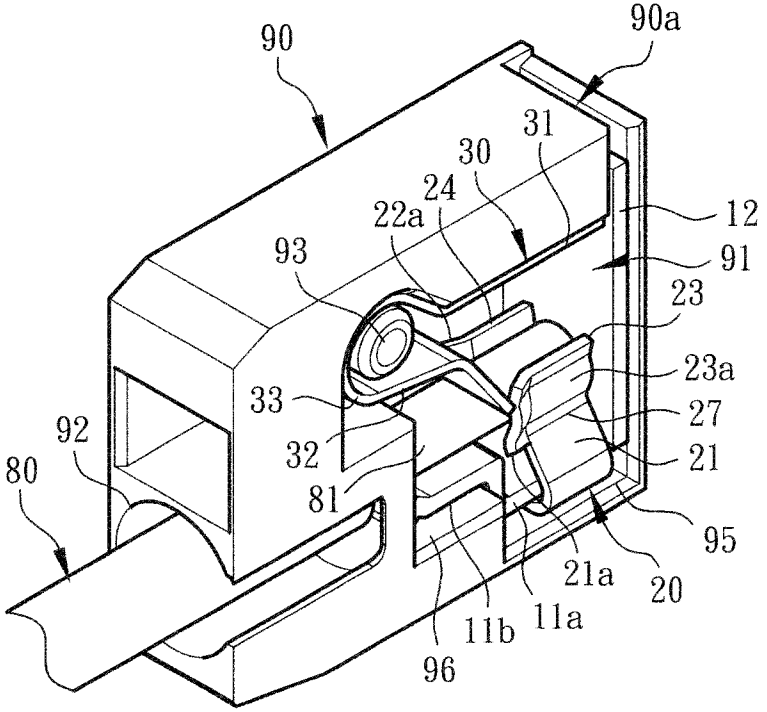
FIG. 6 is a perspective assembled view according to FIG. 5.

Please refer to FIGS. 5, 6 and 7. According to the height of the drawings, the chamber 91 of the case 90 is formed with a lower step section 95 and a higher step section 96. Also, the first section 11 of the main body 10 is formed with a stepped structure. According to the height of the drawings, the first section 11 is defined with a lower step section 11*a* and a higher step section lib respectively connected with the lower step section 95 and the higher step section 96 of the case. The restriction body 20 is disposed on the lower step section 11*a* of the first section 11.

In this embodiment, the free sections 23, 24 of the restriction body 20 are formed with arched sections 23*a*, 24*a*. The inner sides of the arched sections 23*a*, 24*a* are recessed to together define an annular structure in communication with the opening 29 for surrounding and holding the conductive wire 80 and achieving better securing effect.

As shown in FIG. 7, the recessed or annular structure of the inner sides of the arched sections 23*a*, 24*a* of the restriction body 20 holds the conductive wire 80 by larger electro-conductive contact area.

Figure 8:
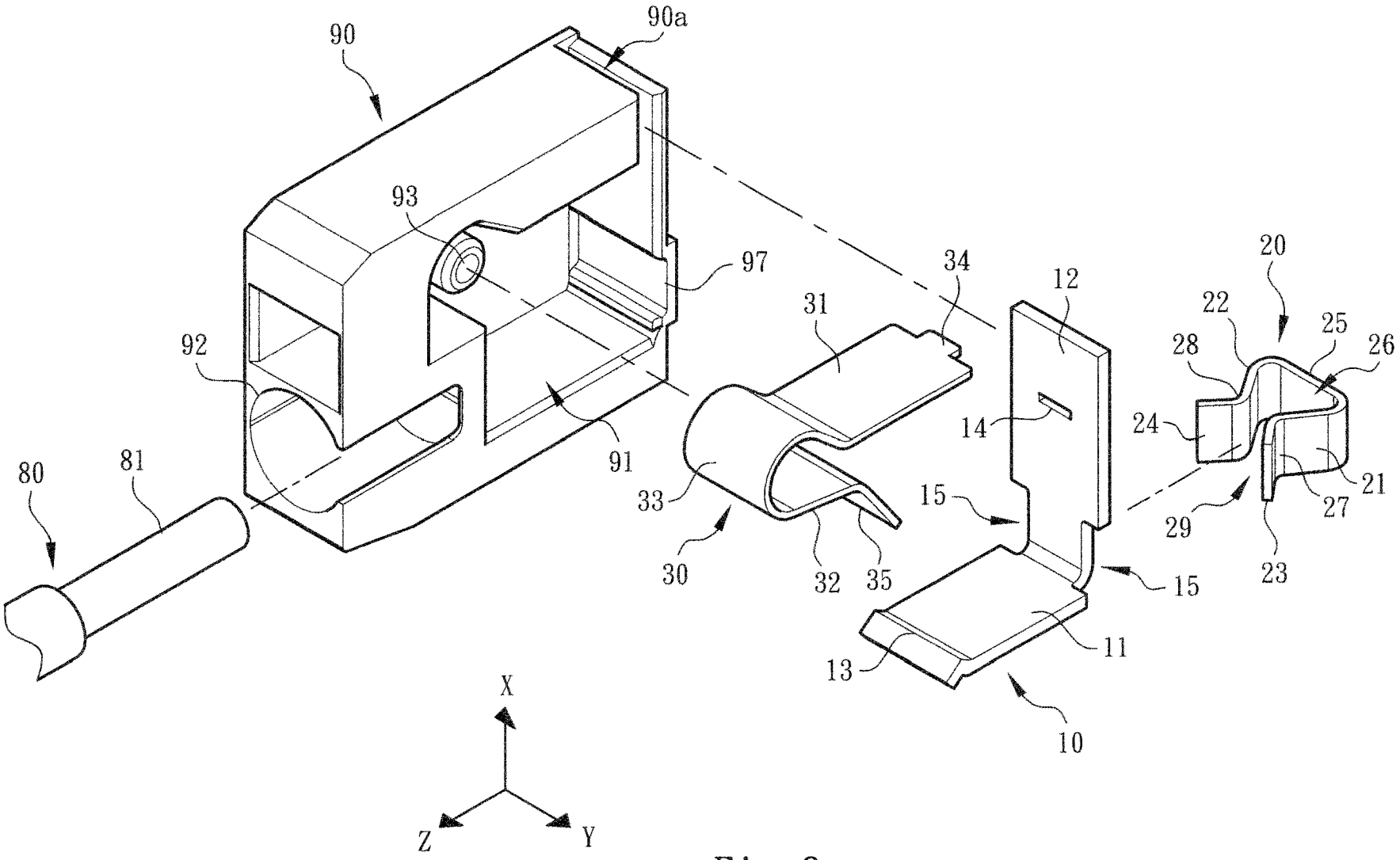
FIG. 8 is a perspective exploded view of a modified embodiment of the present invention, showing the structures of the case and the main body, the metal leaf spring and the restriction body of the conductive component.
Figure 10:
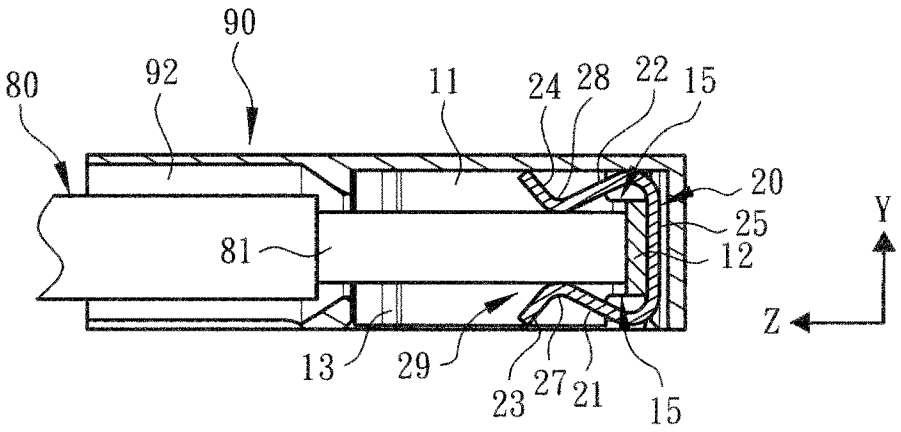
FIG. 10 is a sectional view according to FIG. 9, showing the structural relationship between the main body, the restriction body and the conductive wire.
Figure 9:
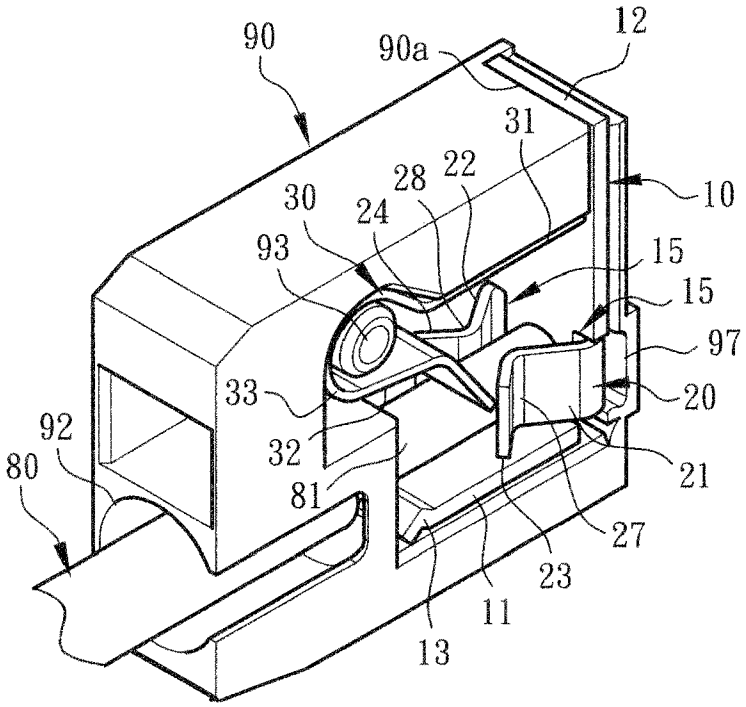
FIG. 9 is a perspective assembled view according to FIG. 8.

Please refer to FIGS. 8, 9 and 10. The case 90 is formed with a recessed section 97 in communication with the chamber 91 for locating or receiving the base section 25 of the restriction body 20. The restriction body 20 is disposed on and connected with the second section 12 of the main body. The opening of the restriction body 20 is open along the Z-direction reference axis (toward the conductive wire 80).

In a preferred embodiment, the lateral sides of the second section 12 of the main body are formed with a neck section 15 for assembling with the restriction body 20 or permitting the first and second arms 21, 22 of the restriction body 20 to pass through and extend along the Z-direction reference axis (or toward the conductive wire 80).

Please refer to FIGS. 9 and 10. When the conductive wire 80 is plugged through the wire plug-in hole 92 into the chamber 91 of the case and the conductive component, the rear end 81 of the conductive wire 80 is securely held by the bent section 27 of the first arm and the bent section 28 of the second arm. Therefore, even if the rear end 81 of the conductive wire is warped up, the rear end 81 of the conductive wire will still keep in contact with the first section 11 of the main body and the first and second arms 21, 22 of the restriction body.

Figure 11:
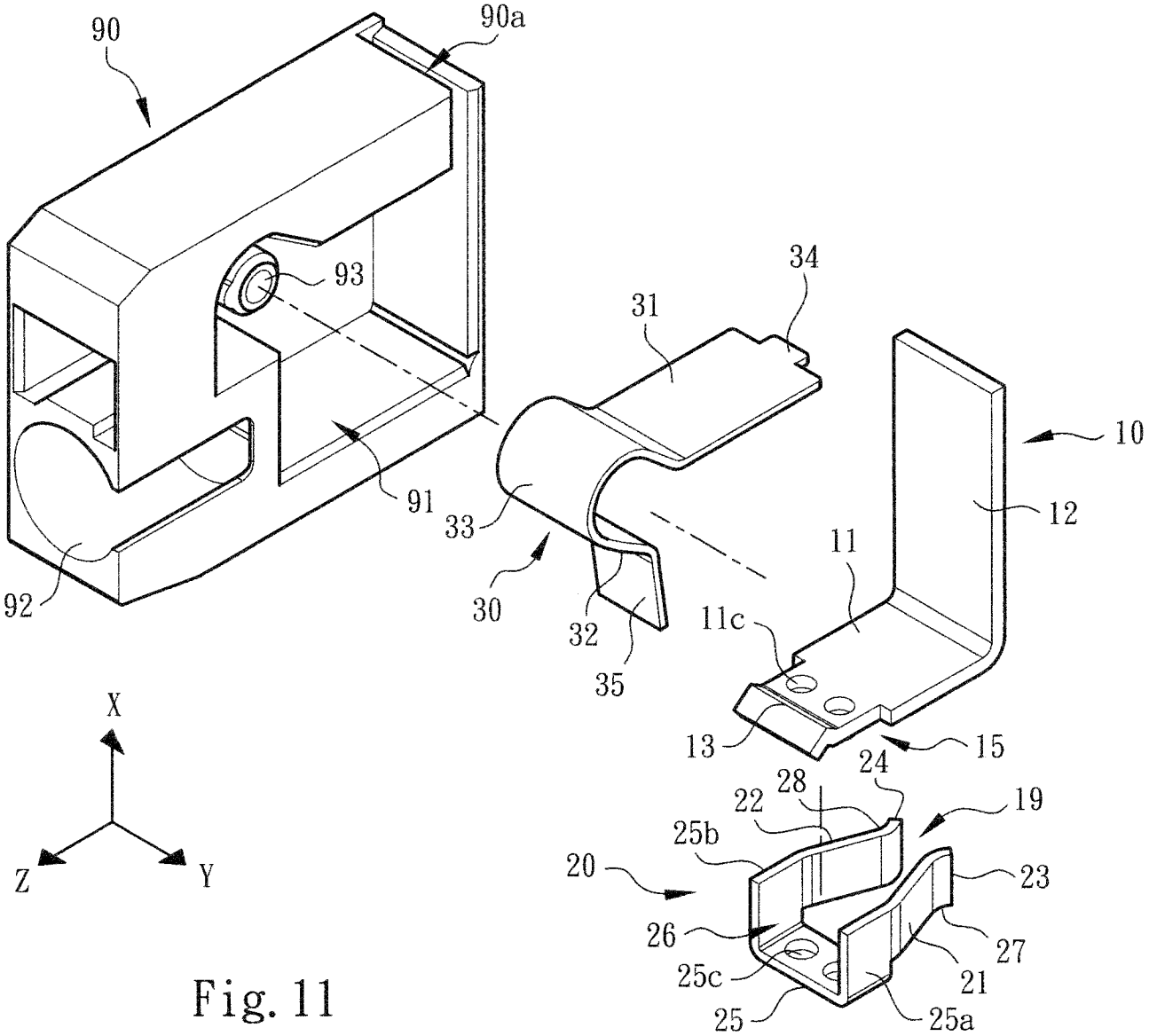
FIG. 11 is a perspective exploded view of a modified embodiment of the present invention, showing the structures of the case and the main body, the metal leaf spring and the restriction body of the conductive component.
Figure 13:
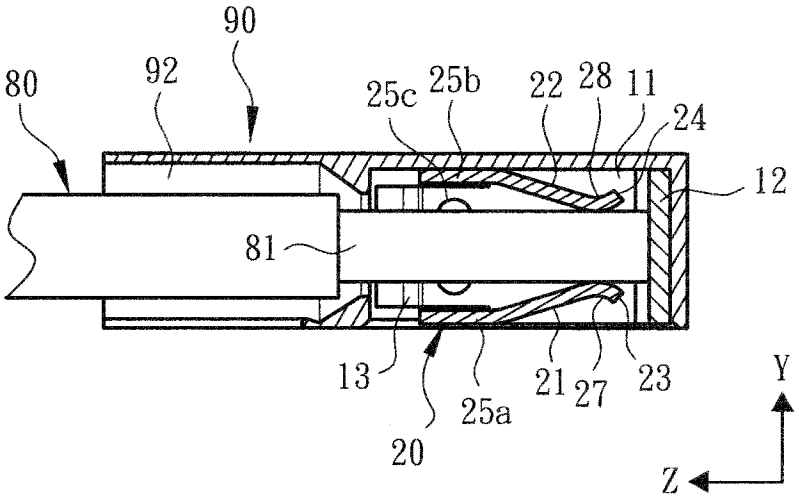
FIG. 13 is a sectional view according to FIG. 12, showing the structural relationship between the main body, the restriction body and the conductive wire.
Figure 12:
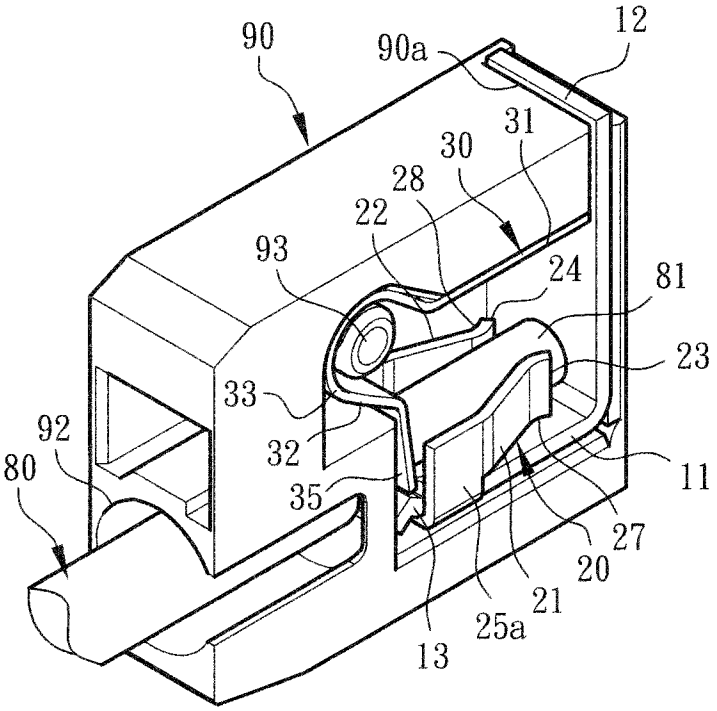
FIG. 12 is a perspective assembled view according to FIG. 11.

Please refer to FIGS. 11, 12 and 13. In a preferred embodiment, the main body 10 (or the first section 11) is selectively formed with a neck section 15 and a connection section 11*c* disposed on the neck section 15. The connection section 11*c* is in the form of hole structure (or boss structure). The base section 25 of the restriction body 20 is formed with connection section 25*c* in the form of boss structure (or hole structure) correspondingly assembled with the connection section 11*c* of the main body.

It should be noted that the connection section 11*c* of the main body 10 (or the first section 11) and the connection section 25*c* of the restriction body 25 can be alternatively integrally connected with each other by means of welding, riveting, etc. Alternatively, the main body 10 can be integrally (bent) and formed with the restriction body 20.

In a preferred embodiment, (two ends) of the base section 25 of the restriction body 20 are bent along the X-direction reference axis to form a first connection wall 25*a* and a second connection wall 25*b*, which together define a mouth section 26. The first and second connection walls 25*a*, 25*b* respectively extend along the Z-direction reference axis (or in the plug-in direction of the conductive wire 80) to form a first arm 21 and a second arm 22 and free sections 23, 24 connected with the first and second arms 21, 22.

As shown in the drawings, the first and second arms 21, 22 of the restriction body respectively gradually obliquely extend (toward each other) along the Z-direction reference axis. A bent section 27, 28 is formed between each of the first and second arms 21, 22 and the free sections 23, 24 of the restriction body, whereby the free section 23 of the first arm 21 and the free section 24 of the second arm 22 are bent to extend away from each other so as to define an opening 29 open to the main body 10 or the second section 12 (along the Z-direction reference axis).

Please refer to FIGS. 12 and 13. When the conductive wire 80 is plugged through the wire plug-in hole 92 into the chamber 91 of the case and the mouth section 26 of the conductive component, the rear end 81 of the conductive wire 80 is securely held by the bent section 27 of the first arm and the bent section 28 of the second arm. Therefore, the conductive wire 80 (or the rear end 81) can keep in contact with the main body 10 and the first and second arms 21, 22 of the restriction body.

Figure 14:
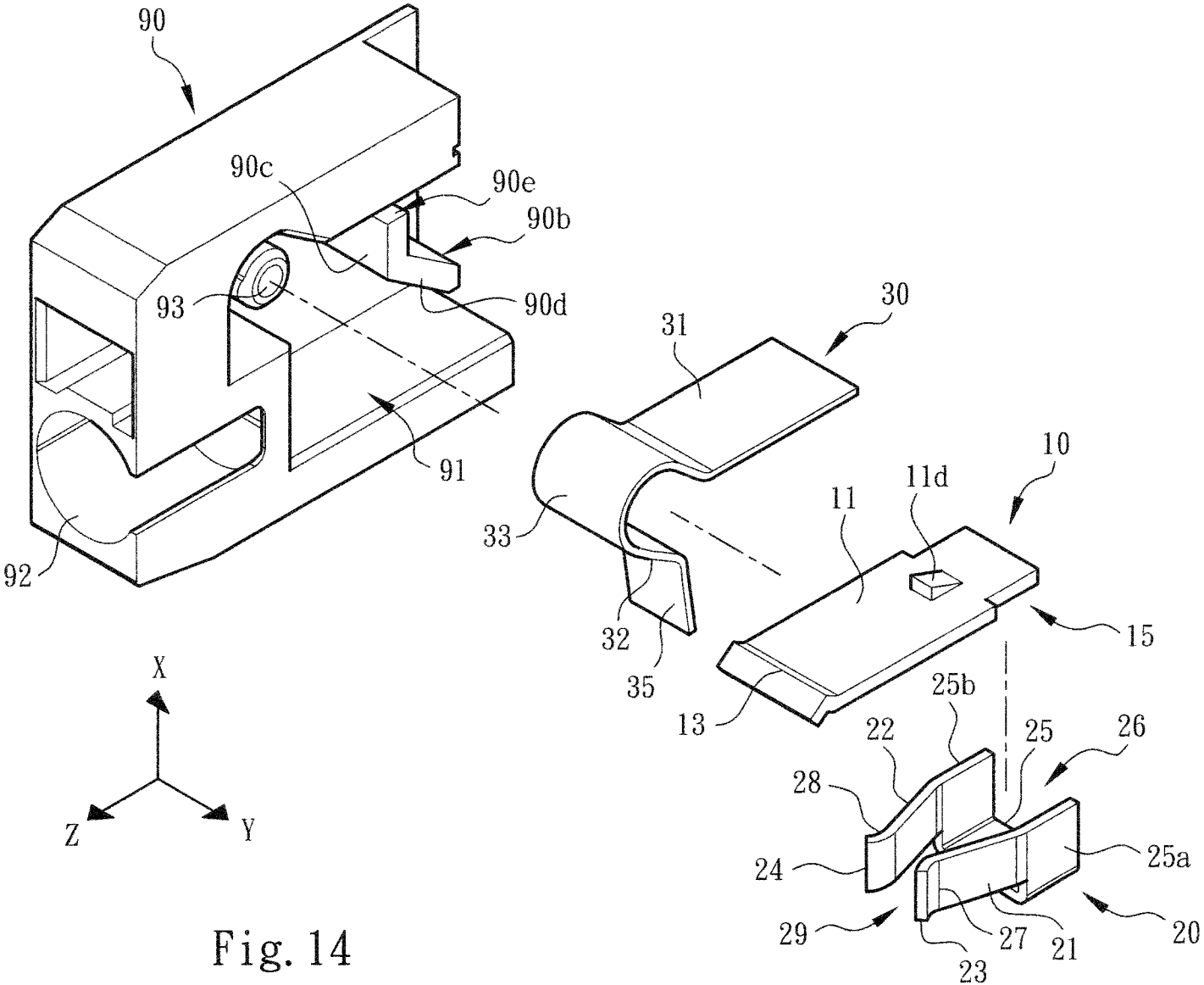
FIG. 14 is a perspective exploded view of a modified embodiment of the present invention, showing the structures of the case and the main body, the metal leaf spring and the restriction body of the conductive component.
Figure 16:
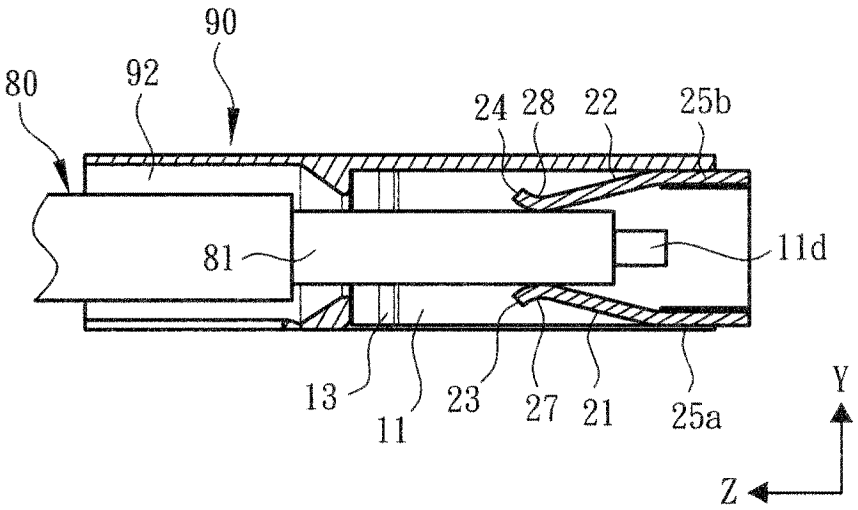
FIG. 16 is a sectional view according to FIG. 15, showing the structural relationship between the main body, the restriction body and the conductive wire.
Figure 15:
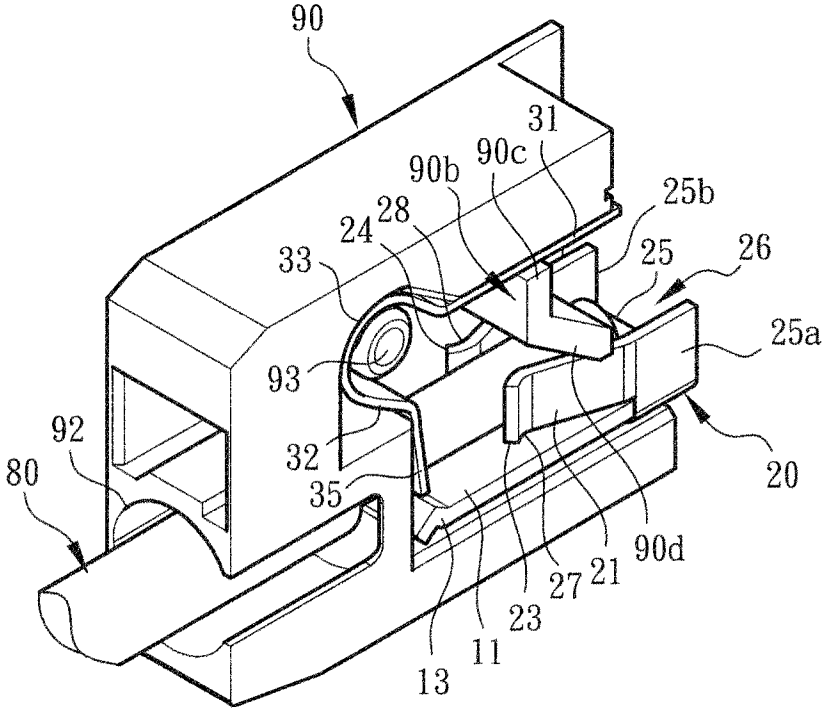
FIG. 15 is a perspective assembled view according to FIG. 14.

Please refer to FIGS. 14, 15 and 16. The main body 10 (or the first section 11) is selectively formed with a neck section 15 and a stopper section 11*d* disposed on the main body 10 (or the first section 11). The stopper section 11*d* is in the form of a block body. The base section 25 of the restriction body 20 is connected with the main body 10 (or the neck section 15 of the first section 11).

In this embodiment, (two ends) of the base section 25 of the restriction body 20 are bent along the X-direction reference axis to form a first connection wall 25*a* and a second connection wall 25*b*, which together define a mouth section 26. The first and second connection walls 25*a*, 25*b* respectively extend along the Z-direction reference axis or in the plug-in direction of the conductive wire 80 to form a first arm 21 and a second arm 22 and free sections 23, 24 connected with the first and second arms 21, 22.

As shown in the drawings, the first and second arms 21, 22 of the restriction body respectively gradually obliquely extend (toward each other) along the Z-direction reference axis. A bent section 27, 28 is formed between each of the first and second arms 21, 22 and the free sections 23, 24 of the restriction body, whereby the free section 23 of the first arm 21 and the free section 24 of the second arm 22 are bent to extend away from each other so as to define an opening 29 open along the Z-direction reference axis or in the plug-in direction of the conductive wire 80.

In this embodiment, a fixing section 90*b* is disposed in the case 90 or the chamber 91. The fixing section 90*b* is a slanted V-shaped block body having a first block body 90*c* and a second block body 90*d* connected with the first block body 90*c*. The second block body 90*d* obliquely extends toward the lower side of the case 90. A gap 90*e* is formed between the first block body 90*c* and the case 90.

As shown in FIG. 15, the first section 31 of the metal leaf spring passes through the gap 90*e* and the first block body 90*c* helps in fixing the metal leaf spring.

As shown in FIGS. 15 and 16, when the conductive wire 80 is plugged through the wire plug-in hole 92 into the chamber 91 of the case and the opening 29 of the conductive component, the rear end 81 of the conductive wire 80 is securely held by the bent section 27 of the first arm and the bent section 28 of the second arm. Therefore, the conductive wire 80 (or the rear end 81) can keep in contact with the main body 10 and the first and second arms 21, 22 of the restriction body. Moreover, the stopper section 11*d* serves to restrict the plug-in depth of the conductive wire 80. Also, the second block body 90*d* helps in pressing and hindering the first and second arms 21, 22 of the restriction body from upward deforming and preventing the conductive wire 80 (or the rear end 81) from being warped up.

Figure 17:
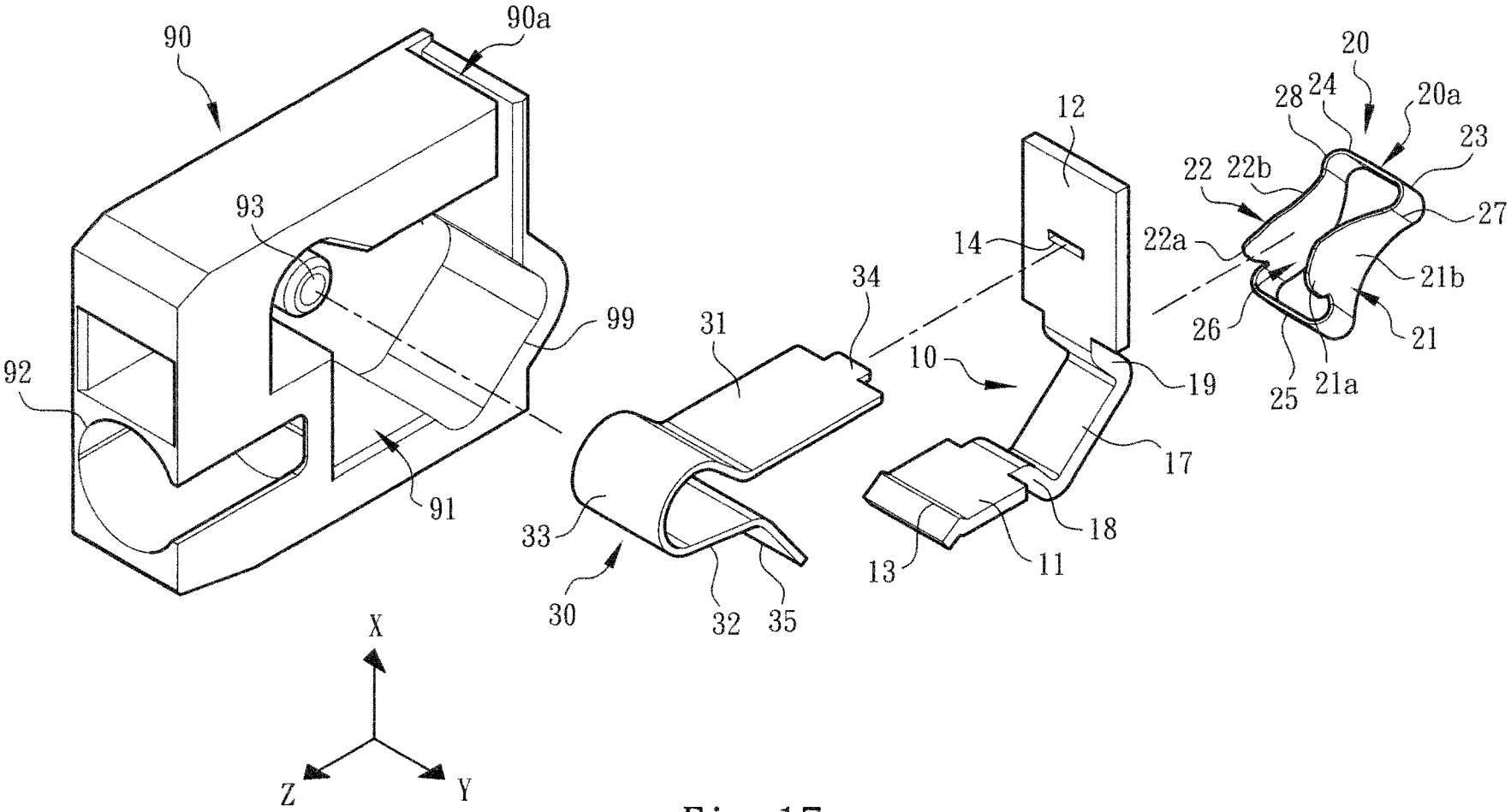
FIG. 17 is a perspective exploded view of a modified embodiment of the present invention, showing the structures of the case and the main body, the metal leaf spring and the restriction body of the conductive component.
Figure 19:
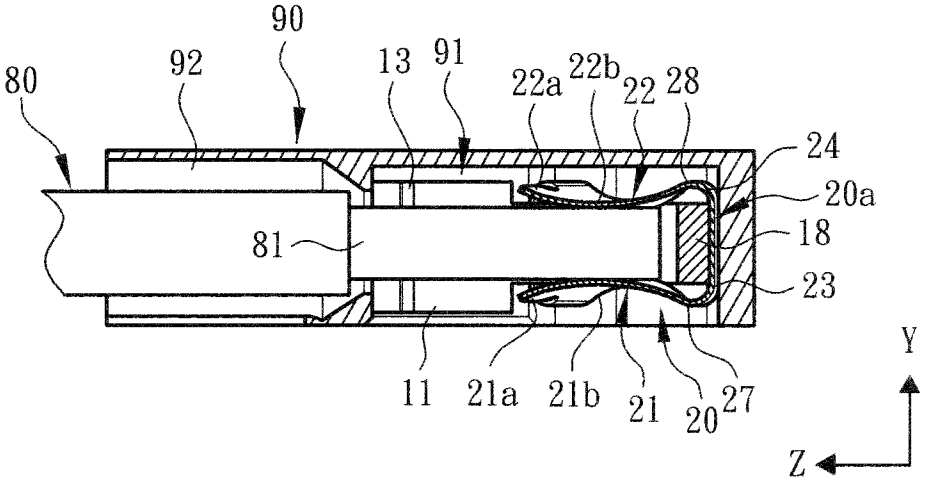
FIG. 19 is a sectional view according to FIG. 18, showing the structural relationship between the main body, the restriction body and the conductive wire.
Figure 18:
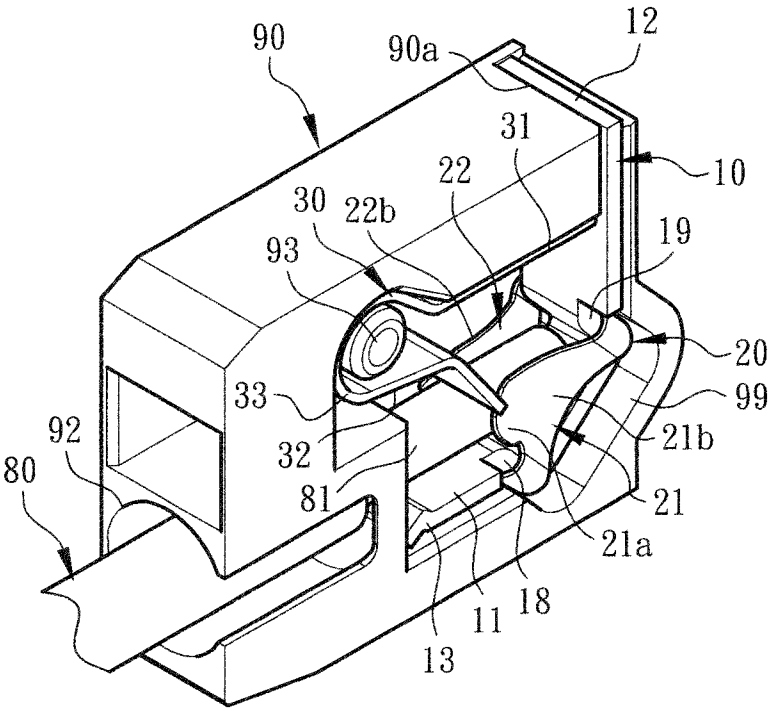
FIG. 18 is a perspective assembled view according to FIG. 17.

Please refer to FIGS. 17, 18 and 19. In a modified embodiment, the other end of the case 90 opposite to the wire plug-in hole 92 is formed with an inclined U-shaped sink section 99 in communication with the chamber 91. An inclined section 17 is formed between the first and second sections 11, 12 of the main body 10. Two ends of the inclined section 17 are formed with a first bridge section 18 and a second bridge section 19 respectively connected with the first and second sections 11, 12. The inclined section 17 and the first and second bridge sections 18, 19 together form a U-shaped structure.

In this embodiment, the inclined section 17 and the first and second bridge sections 18, 19 are assembled on the inclined sink section 99 of the case 90. Moreover, the free section 23 of the first arm 21 and the free section 24 of the second arm 22 of the restriction body are bent to extend toward each other and connect with each other to form a connection section 20*a* so as to together define a mouth section 26 in a closed form.

As shown in the drawings, the connection section 20*a* of the restriction body 20 contacts or latches with the second bridge section 19 of the main body, while the base section 25 contacts or latches with the first bridge section 18 of the main body. The wing sections 21*a*, 22*a* have the form of arched blade structures protruding along the X-direction reference axis and the Z-direction reference axis. In addition, the first and second arms 21, 22 (and/or the wing sections 21*a*, 22*a*) respectively have caved sections 21*b*, 22*b*, which are arched to extend toward the mouth section 26 so as to increase the length of the first and second arms 21, 22 and the elastic deformation amount thereof, (whereby the first and second arms 21, 22 are uneasy to permanently deform). Such structure is applicable to different specifications and sizes of conductive wires 80 to more securely press and restrict the conductive wires 80.

As shown in FIGS. 18 and 19, the first and second arms 21, 22 cooperate with the caved sections 21*b*, 22*b* and/or the wing sections 21*a*, 22*a* to enlarge the electro-conductive contact area with the conductive wire 80.

To speak representatively, in comparison with the conventional wire connection terminal, the conductive component structure of conductive wire connection device of the present invention has the following advantages:

1. The main body 10, the restriction body 20 and the metal leaf spring 30 of the conductive component and the relevant components and structures have been redesigned. For example, the first section 11 or the second section 12 of the main body 10 is assembled with the restriction body 20. Alternatively, the first section 11 is formed with the lower step section 11*a* and the higher step section lib connected with the lower step section 95 and the higher step section 96 of the case 90. Alternatively, the inclined section 17 and the first and second bridge sections 18, 19 are formed between the first and second sections 11, 12 corresponding to the inclined sink section 99 of the case 90. The restriction body 20 has a first arm 21, a second arm 22, free sections 23, 24 and bent sections 27, 28, whereby the restriction body 20 is formed with the mouth section 26 and the opening 29 or the mouth section 26 in a closed form. In addition, the restriction body 20 is formed with the first connection wall 25*a* and the second connection wall 25*b* and/or the caved sections 21*b*, 22*b* and the wing sections 21*a*, 22*a*. The present invention is obviously different from the conventional wire connection terminal in use and operation form. Also, the present invention changes the electro-conductive structure and assembling relationship of the conventional electrical connection terminal or switch wire connection device.

2. In condition that the thickness of the conductive component and/or the metal leaf spring 30 is not increased, the cooperative structures of the conductive component or the restriction body provides a more idealistic system and greater elastic deformation amount for pressing/restricting the conductive wire 80 than the conventional electrical connection terminal. The conductive component keeps in multi-section contact with the conductive wire 80. Therefore, the conductive component is applicable to some electrical connection terminals or switch wire connection devices, permitting a large-diameter conductive wire to connect therewith. In addition, the present invention improves the shortcomings of the conventional structure that the pressing force applied to the conductive wire is insufficient and the conductive wire can be hardly securely pressed and restricted so that the conductive wire is apt to deflect or swing (due to incautious touch of an operator) to lead to poor contact and insecurity.

3. The main body 10 is assembled with the restriction body 20 to provide a conductive component structure capable of helping the metal leaf spring to press and restrict the conductive wire 80. The present invention obviously improves the shortcoming of the conventional structure that when the metal leaf spring presses the conductive wire, a leverage effect is often produced to cause the rear end of the conductive wire to warp up (or leave the conductive component) so that the electro-conductive contact area is reduced to affect the electro-conduction efficiency.

In conclusion, the conductive component structure of conductive wire connection device of the present invention is different from the conventional wire connection terminal in space form and is advantageous over the conventional wire connection terminal. The conductive component structure of electrical wire connection device of the present invention is effective, greatly advanced and inventive.

The above embodiments are only used to illustrate the present invention, not intended to limit the scope thereof. Many modifications of the above embodiments can be made without departing from the spirit of the present invention.

What is claimed is:

1. A conductive component structure of conductive wire connection device, the conductive component being defined with an X-direction reference axis, a Y-direction reference axis and a Z-direction reference axis, the Z-direction reference axis being parallel to a wire plug-in direction of a conductive wire, the conductive component comprising:

a main body made of an electro-conductive material in the form of a plate body, the main body at least having a first section;

a metal leaf spring disposed to resiliently press a portion of the conductive wire against the main body; and a restriction body disposed on the main body, the restriction body having a base section, a first arm and a second arm connected with the base section and free sections connected with the first and second arms, the first and second arms of the restriction body being respectively bent from two sides of the base section to extend and define a mouth section, a bent section being formed between each of the first and second arms and the free sections of the first and second arms, the free section of the first arm and the free section of the second arm being bent to extend away from each other or toward each other, the first and second arms of the restriction body being thereby configured to provide an elastic holding effect on another portion of the conductive wire.

2. The conductive component structure of conductive wire connection device as claimed in claim 1, wherein the conductive component in cooperation with a metal leaf spring is mounted in a chamber of a case made of insulation material, the case having a wire plug-in hole arranged along the Z-direction reference axis in communication with the chamber, the metal leaf spring including a first section, a second section, and a bow section connected between the first and second sections.

3. The conductive component structure of conductive wire connection device as claimed in claim 1, wherein the conductive component in cooperation with a metal leaf spring is mounted in a chamber of a case made of insulation material, the case having a wire plug-in hole arranged along the Z-direction reference axis in communication with the chamber, a lower section of the chamber of the case being formed with a lower step section and a higher step section, the metal leaf spring including a first section, a second section, and a bow section connected between the first and second sections.

4. The conductive component structure of conductive wire connection device as claimed in claim 1, wherein the conductive component in cooperation with a metal leaf spring is mounted in a chamber of a case made of insulation material, the case having a wire plug-in hole arranged along the Z-direction reference axis in communication with the chamber, an end of the case opposite to the wire plug-in hole being formed with an inclined U-shaped sink section in communication with the chamber, the metal leaf spring including a first section, a second section and a bow section connected between the first and second sections.

5. The conductive component structure of conductive wire connection device as claimed in claim 1, wherein the main body has a second section connected with the first section, the first section of the main body being in parallel to the Z-direction reference axis, the second section of the main body being perpendicularly connected with the first section, one end of the first section being formed with a raised ridge section, the restriction body being disposed on the first section, the restriction body being made of metal material and integrally formed on the main body or assembled with the main body, the first and second arms of the restriction body being respectively bent from two sides of the base section to gradually obliquely extend toward each other along the X-direction reference axis to define a mouth section with a triangular configuration, the free section of the first arm and the free section of the second arm being bent to extend away from each other so as to define an opening open along the X-direction reference axis, the restriction body being formed with wing sections respectively protruding from the first and second arms along the Z-direction reference axis and diverging to outer side of the restriction body.

6. The conductive component structure of conductive wire connection device as claimed in claim 2, wherein the main body has a second section connected with the first section, the first section of the main body being in parallel to the Z-direction reference axis, the second section of the main body being perpendicularly connected with the first section, one end of the first section being formed with a raised ridge section, the restriction body being disposed on the first section, the restriction body being made of metal material and integrally formed on the main body or assembled with the main body, the first and second arms of the restriction body being respectively bent from two sides of the base section to gradually obliquely extend toward each other along the X-direction reference axis to define a mouth section with a triangular configuration, the free section of the first arm and the free section of the second arm being bent to extend away from each other so as to define an opening open along the X-direction reference axis, the restriction body being formed with wing sections respectively protruding from the first and second arms along the Z-direction reference axis and diverging to outer side of the restriction body.

7. The conductive component structure of conductive wire connection device as claimed in claim 1, wherein the main body has a second section connected with the first section, the first section of the main body being in parallel to the Z-direction reference axis, the second section of the main body being perpendicularly connected with the first section, one end of the first section being formed with a raised ridge section, the first section of the main body being formed with a stepped structure, whereby the first section is defined with a lower step section and a higher step section, the restriction body being disposed on the lower step section, the restriction body being made of metal material and integrally formed on the main body or assembled with the main body, the first and second arms of the restriction body being respectively bent from two sides of the base section to gradually obliquely extend toward each other along the X-direction reference axis to define a mouth section, the free section of the first arm and the free section of the second arm being bent to extend away from each other so as to define an opening open along the X-direction reference axis, the restriction body being formed with wing sections respectively protruding from the first and second arms along the Z-direction reference axis and diverging to outer side of the restriction body, the free sections of the restriction body being formed with arched sections, inner sides of the arched sections being recessed to together define an annular structure in communication with the opening.

8. The conductive component structure of conductive wire connection device as claimed in claim 3, wherein the main body has a second section connected with the first section, the first section of the main body being in parallel to the Z-direction reference axis, the second section of the main body being perpendicularly connected with the first section, one end of the first section being formed with a raised ridge section, the first section of the main body being formed with a stepped structure, whereby the first section is defined with a lower step section and a higher step section, the restriction body being disposed on the lower step section, the restriction body being made of metal material and integrally formed on the main body or assembled with the main body, the first and second arms of the restriction body being respectively bent from two sides of the base section to gradually obliquely extend toward each other along the X-direction reference axis to define a mouth section, the free section of the first arm and the free section of the second arm being bent to extend away from each other so as to define an opening open along the X-direction reference axis, the restriction body being formed with wing sections respectively protruding from the first and second arms along the Z-direction reference axis and diverging to outer side of the restriction body, the free sections of the restriction body being formed with arched sections, inner sides of the arched sections being recessed to together define an annular structure in communication with the opening.

9. The conductive component structure of conductive wire connection device as claimed in claim 1, wherein the main body has a second section connected with the first section, the first section of the main body being in parallel to the Z-direction reference axis, the second section of the main body being perpendicularly connected with the first section, one end of the first section being formed with a raised ridge section, the restriction body being disposed on and connected with the second section of the main body, the restriction body being made of metal material and integrally formed on the main body or assembled with the main body, the first and second arms of the restriction body being respectively bent from two sides of the base section to gradually obliquely extend toward each other along the Z-direction reference axis to define a mouth section, the opening of the restriction being open along the Z-direction reference axis, lateral sides of the second section of the main body being formed with a neck section permitting the first and second arms of the restriction body to pass through and extend along the Z-direction reference axis.

10. The conductive component structure of conductive wire connection device as claimed in claim 2, wherein the main body has a second section connected with the first section, the first section of the main body being in parallel to the Z-direction reference axis, the second section of the main body being perpendicularly connected with the first section, one end of the first section being formed with a raised ridge section, the restriction body being disposed on and connected with the second section of the main body, the restriction body being made of metal material and integrally formed on the main body or assembled with the main body, the first and second arms of the restriction body being respectively bent from two sides of the base section to gradually obliquely extend toward each other along the Z-direction reference axis to define a mouth section, the opening of the restriction being open along the Z-direction reference axis, lateral sides of the second section of the main body being formed with a neck section permitting the first and second arms of the restriction body to pass through and extend along the Z-direction reference axis.

11. The conductive component structure of conductive wire connection device as claimed in claim 2, wherein the main body has a second section connected with the first section, the first section of the main body being in parallel to the Z-direction reference axis, the second section of the main body being perpendicularly connected with the first section, one end of the first section being formed with a neck section and a raised ridge section, a connection section being disposed on the neck section and connected with the base section of the restriction body, the restriction body being made of metal material and integrally formed on the main body or assembled with the main body, the base section of the restriction body being bent along the X-direction reference axis to form a first connection wall and a second connection wall, which together define a mouth section, the first and second connection walls respectively extending along the Z-direction reference axis to connect with the first arm and the second arm and the free sections of the first and second arms, the first and second arms of the restriction body respectively gradually obliquely extending toward each other along the Z-direction reference axis, the free section of the first arm and the free section of the second arm being bent to extend away from each other so as to define the opening open in the plug-in direction of the conductive wire.

12. The conductive component structure of conductive wire connection device as claimed in claim 11, wherein the connection section of the main body is in the form of hole structure or boss structure, the base section of the restriction body being formed with a connection section in the form of boss structure or hole structure correspondingly assembled with the connection section of the main body.

13. The conductive component structure of conductive wire connection device as claimed in claim 1, wherein the first section of the main body is in parallel to the Z-direction reference axis, one end of the first section being formed with a raised ridge section, the first section being formed with a neck section and a stopper section, the stopper section being in the form of a block body, the restriction body being made of metal material and integrally formed on the main body or assembled with the main body, the base section of the restriction body being connected with the neck section of the first section of the main body, two ends of the base section of the restriction body being bent along the X-direction reference axis to form a first connection wall and a second connection wall, which together define a mouth section, the first and second connection walls respectively extending along the Z-direction reference axis to connect with the first arm and the second arm and the free sections of the first and second arms, the first and second arms of the restriction body respectively gradually obliquely extending toward each other along the Z-direction reference axis, the free section of the first arm and the free section of the second arm being bent to extend away from each other so as to define the opening open in the plug-in direction of the conductive wire.

14. The conductive component structure of conductive wire connection device as claimed in claim 1, wherein the main body has a second section connected with the first section, an inclined section being formed between the first and second sections, two ends of the inclined section being formed with a first bridge section and a second bridge section respectively connected with the first and second sections, the inclined section and the first and second bridge sections together forming a U-shaped structure, the restriction body being made of metal material and integrally formed on the main body or assembled with the main body, the free section of the first arm and the free section of the second arm of the restriction body being bent to extend toward each other and connect with each other to form a connection section so as to together define a mouth section in a closed form, the connection section of the restriction body contacting the second bridge section of the main body, the base section of the restriction body contacting the first bridge section, the first and second arms of the restriction body being respectively formed with wing sections in the form of arched blade structures protruding along the X-direction reference axis and the Z-direction reference axis, the first and second arms respectively having caved sections, which are arched to extend toward the mouth section.

15. The conductive component structure of conductive wire connection device as claimed in claim 4, wherein the main body has a second section connected with the first section, an inclined section being formed between the first and second sections, two ends of the inclined section being formed with a first bridge section and a second bridge section respectively connected with the first and second sections, the inclined section and the first and second bridge sections together forming a U-shaped structure, the restriction body being made of metal material and integrally formed on the main body or assembled with the main body, the free section of the first arm and the free section of the second arm of the restriction body being bent to extend toward each other and connect with each other to form a connection section so as to together define a mouth section in a closed form, the connection section of the restriction body contacting the second bridge section of the main body, the base section of the restriction body contacting the first bridge section, the first and second arms of the restriction body being respectively formed with wing sections in the form of arched blade structures protruding along the X-direction reference axis and the Z-direction reference axis, the first and second arms respectively having caved sections, which are arched to extend toward the mouth section.

16. The conductive component structure of conductive wire connection device as claimed in claim 5, wherein the second section of the main body is located and assembled in a locating slot of the case, one of the case and the second section of the main body being formed with a locating hole.

17. The conductive component structure of conductive wire connection device as claimed in claim 6, wherein the second section of the main body is located and assembled in a locating slot of the case, one of the case and the second section of the main body being formed with a locating hole.

18. The conductive component structure of conductive wire connection device as claimed in claim 7, wherein the second section of the main body is located and assembled in a locating slot of the case, one of the case and the second section of the main body being formed with a locating hole.

19. The conductive component structure of conductive wire connection device as claimed in claim 8, wherein the second section of the main body is located and assembled in a locating slot of the case, one of the case and the second section of the main body being formed with a locating hole.

20. The conductive component structure of conductive wire connection device as claimed in claim 9, wherein the second section of the main body is located and assembled in a locating slot of the case, one of the case and the second section of the main body being formed with a locating hole.

21. The conductive component structure of conductive wire connection device as claimed in claim 10, wherein the second section of the main body is located and assembled in a locating slot of the case, one of the case and the second section of the main body being formed with a locating hole.

22. The conductive component structure of conductive wire connection device as claimed in claim 11, wherein the second section of the main body is located and assembled in a locating slot of the case, one of the case and the second section of the main body being formed with a locating hole.

23. The conductive component structure of conductive wire connection device as claimed in claim 12, wherein the second section of the main body is located and assembled in a locating slot of the case, one of the case and the second section of the main body being formed with a locating hole.

24. The conductive component structure of conductive wire connection device as claimed in claim 14, wherein the second section of the main body is located and assembled in a locating slot of the case, one of the case and the second section of the main body being formed with a locating hole.

25. The conductive component structure of conductive wire connection device as claimed in claim 15, wherein the second section of the main body is located and assembled in a locating slot of the case, one of the case and the second section of the main body being formed with a locating hole.

26. A conductive component structure of conductive wire connection device, the conductive component being defined with an X-direction reference axis, a Y-direction reference axis and a Z-direction reference axis, the Z-direction reference axis being parallel to a wire plug-in direction of a conductive wire, the conductive component comprising:

a main body made of an electro-conductive material in the form of a plate body, the main body at least having a first section; and a restriction body disposed on the main body, the restriction body having a base section, a first arm and a second arm connected with the base section and free sections connected with the first and second arms, the first and second arms of the restriction body being respectively bent from two sides of the base section to extend and define a mouth section, a bent section being formed between each of the first and second arms and the free sections of the first and second arms, the free section of the first arm and the free section of the second arm being configured to extend away from each other or toward each other, the restriction body being thereby configured to provide an elastic holding effect on the conductive wire;

wherein the conductive component in cooperation with a metal leaf spring is mounted in a chamber of a case made of insulation material, the case having a wire plug-in hole arranged along the Z-direction reference axis in communication with the chamber, the case having a fixing section, the metal leaf spring including a first section, a second section, and a bow section connected between the first and second sections.

27. The conductive component structure of conductive wire connection device as claimed in claim 26, wherein the fixing section is a slanted V-shaped block body having a first block body and a second block body connected with the first block body, the second block body obliquely extending toward the lower side of the case, a gap being formed between the first block body and the case.

28. The conductive component structure of conductive wire connection device as claimed in claim 26, wherein the first section of the main body is in parallel to the Z-direction reference axis, one end of the first section being formed with a raised ridge section, the first section being formed with a neck section and a stopper section, the stopper section being in the form of a block body, the restriction body being made of metal material and integrally formed on the main body or assembled with the main body, the base section of the restriction body being connected with the neck section of the first section of the main body, two ends of the base section of the restriction body being bent along the X-direction reference axis to form a first connection wall and a second connection wall, which together define a mouth section, the first and second connection walls respectively extending along the Z-direction reference axis to connect with the first arm and the second arm and the free sections of the first and second arms, the first and second arms of the restriction body respectively gradually obliquely extending toward each other along the Z-direction reference axis, the free section of the first arm and the free section of the second arm being bent to extend away from each other so as to define the opening open in the plug-in direction of the conductive wire.

29. The conductive component structure of conductive wire connection device as claimed in claim 27, wherein the first section of the main body is in parallel to the Z-direction reference axis, one end of the first section being formed with a raised ridge section, the first section being formed with a neck section and a stopper section, the stopper section being in the form of a block body, the restriction body being made of metal material and integrally formed on the main body or assembled with the main body, the base section of the restriction body being connected with the neck section of the first section of the main body, two ends of the base section of the restriction body being bent along the X-direction reference axis to form a first connection wall and a second connection wall, which together define a mouth section, the first and second connection walls respectively extending along the Z-direction reference axis to connect with the first arm and the second arm and the free sections of the first and second arms, the first and second arms of the restriction body respectively gradually obliquely extending toward each other along the Z-direction reference axis, the free section of the first arm and the free section of the second arm being bent to extend away from each other so as to define the opening open in the plug-in direction of the conductive wire.

30. A conductive component structure of conductive wire connection device, the conductive component being defined with an X-direction reference axis, a Y-direction reference axis and a Z-direction reference axis, the Z-direction reference axis being parallel to a wire plug-in direction of a conductive wire, the conductive component comprising:

a main body made of an electro-conductive material in the form of a plate body, the main body at least having a first section; and a restriction body disposed on the main body, the restriction body having a base section, a first arm and a second arm connected with the base section and free sections connected with the first and second arms, the first and second arms of the restriction body being respectively bent from two sides of the base section to extend and define a mouth section, a bent section being formed between each of the first and second arms and the free sections of the first and second arms, the free section of the first arm and the free section of the second arm being configured to extend away from each other or toward each other, the restriction body being thereby configured to provide an elastic holding effect on the conductive wire;

wherein the main body has a second section connected with the first section, the first section of the main body being in parallel to the Z-direction reference axis, the second section of the main body being perpendicularly connected with the first section, one end of the first section being formed with a neck section and a raised ridge section, a connection section being disposed on the neck section and connected with the base section of the restriction body, the restriction body being made of metal material and integrally formed on the main body or assembled with the main body, the base section of the restriction body being bent along the X-direction reference axis to form a first connection wall and a second connection wall, which together define a mouth section, the first and second connection walls respectively extending along the Z-direction reference axis to connect with the first arm and the second arm and the free sections of the first and second arms, the first and second arms of the restriction body respectively gradually obliquely extending toward each other along the Z-direction reference axis, the free section of the first arm and the free section of the second arm being bent to extend away from each other so as to define the opening open in the plug-in direction of the conductive wire.

31. The conductive component structure of conductive wire connection device as claimed in claim 30, wherein the connection section of the main body is in the form of hole structure or boss structure, the base section of the restriction body being formed with a connection section in the form of boss structure or hole structure correspondingly assembled with the connection section of the main body.

32. The conductive component structure of conductive wire connection device as claimed in claim 30, wherein the second section of the main body is located and assembled in a locating slot of the case, one of the case and the second section of the main body being formed with a locating hole.

33. The conductive component structure of conductive wire connection device as claimed in claim 31, wherein the second section of the main body is located and assembled in a locating slot of the case, one of the case and the second section of the main body being formed with a locating hole.

* * * * *